US011425506B2

(12) United States Patent
Badger et al.

(10) Patent No.: US 11,425,506 B2
(45) Date of Patent: Aug. 23, 2022

(54) COMPACT ELECTROACOUSTIC TRANSDUCER AND LOUDSPEAKER SYSTEM AND METHOD OF USE THEREOF

(71) Applicant: CLEAN ENERGY LABS, LLC, Austin, TX (US)

(72) Inventors: David A. Badger, Lago Vista, TX (US); Joseph F. Pinkerton, Austin, TX (US); William N. Everett, Cedar Park, TX (US)

(73) Assignee: Clean Energy Labs, LLC, Austin, TX (US)

( * ) Notice: Subject to any disclaimer, the term of this patent is extended or adjusted under 35 U.S.C. 154(b) by 0 days.

(21) Appl. No.: 17/056,512

(22) PCT Filed: May 20, 2019

(86) PCT No.: PCT/US2019/033088
§ 371 (c)(1),
(2) Date: Nov. 18, 2020

(87) PCT Pub. No.: WO2019/222733
PCT Pub. Date: Nov. 21, 2019

(65) Prior Publication Data

US 2021/0219063 A1 Jul. 15, 2021

Related U.S. Application Data

(60) Provisional application No. 62/673,620, filed on May 18, 2018.

(51) Int. Cl.
*H04R 19/02* (2006.01)

(52) U.S. Cl.
CPC ..... *H04R 19/02* (2013.01)

(58) Field of Classification Search
CPC ..... H04R 1/023; H04R 1/025; H04R 1/24; H04R 1/227; H04R 1/403; H04R 1/2819;
(Continued)

(56) References Cited

U.S. PATENT DOCUMENTS 3,941,946 A * 3/1976 Kawakami ..... H04R 19/02 381/116
3,980,838 A * 9/1976 Yakushiji ..... H04R 19/013 381/191

(Continued)

FOREIGN PATENT DOCUMENTS

WO 2016127119 A1 8/2016
WO 2019222733 A1 11/2019

OTHER PUBLICATIONS

International Searching Authority, International Search Report and Written Opinion for PCT/US2019/033088, dated Aug. 9, 2019, 13 pages.

*Primary Examiner* — Oyesola C Ojo
(74) *Attorney, Agent, or Firm* — Dickinson Wright PLLC; Ross Spencer Garsson

(57) ABSTRACT

An improved compact electroacoustic transducer and loudspeaker system. The electroacoustic transducer (or array of electroacoustic transducers) can generate a desired sound by the use of pressurized airflow. The electroacoustic transducer does not have frames (unlike prior electroacoustic transducers) and an electrically conductive membrane is now supported by a pair of non-conductive vent members.

14 Claims, 14 Drawing Sheets

(58) Field of Classification Search
CPC ... H04R 3/12; H04R 5/02; H04R 5/04; H04R 7/04; H04R 19/02; H04R 31/006
See application file for complete search history.

(56) References Cited

U.S. PATENT DOCUMENTS

| | | | | |
|---|---|---|---|---|
| 4,246,448 | A * | 1/1981 | Tam | H04R 19/013 381/370 |
| 4,491,697 | A * | 1/1985 | Tanaka | H04R 19/016 381/174 |
| 9,143,868 | B2 | 9/2015 | Pinkerton et al. | |
| 9,167,353 | B2 | 10/2015 | Pinkerton et al. | |
| 9,264,795 | B2 | 2/2016 | Pinkerton et al. | |
| 9,516,426 | B2 | 12/2016 | Pinkerton | |
| 9,820,057 | B2 | 11/2017 | Pinkerton et al. | |
| 9,826,313 | B2 | 11/2017 | Pinkerton et al. | |
| 9,924,275 | B2 | 3/2018 | Pinkerton et al. | |
| 10,250,997 | B2 | 4/2019 | Pinkerton et al. | |
| 2015/0208174 | A1* | 7/2015 | Pinkerton | B06B 1/0269 381/165 |
| 2016/0234603 | A1* | 8/2016 | Pinkerton | H04R 3/12 |
| 2016/0249142 | A1* | 8/2016 | Beyfuss | H04R 25/607 |
| 2016/0345083 | A1* | 11/2016 | Pinkerton | H04R 1/403 |

* cited by examiner

COMPACT ELECTROACOUSTIC TRANSDUCER AND LOUDSPEAKER SYSTEM AND METHOD OF USE THEREOF

RELATED PATENT APPLICATIONS

This application is a 35 U.S.C § 371 national application of PCT Application No. PCT/US2019/033088, filed on May 20, 2019, entitled "Compact Electroacoustic Transducer And Loudspeaker System And Method Of Use Thereof," claiming priority to U.S. Provisional Patent Ser. No. 62/673,620, filed on May 18, 2018, to David A. Badger et al., entitled "Compact Electroacoustic Transducer And Loudspeaker System And Method Of Use Thereof."

This application is related to U.S. patent Ser. No. 15/333,488 filed on Oct. 25, 2016 and is entitled "Compact Electroacoustic Transducer and Loudspeaker System and Method Of Use Thereof" (the Pinkerton '488 Application").

This application is also related to U.S. patent application Ser. No. 14/309,615, filed on Jun. 19, 2014 (the "Pinkerton '615 Application"), which is a continuation-in-part to U.S. patent application Ser. No. 14/161,550, filed Jan. 22, 2014. This application is also related to U.S. patent application Ser. No. 14/047,813, filed Oct. 7, 2013, which is a continuation-in-part of International Patent Application No. PCT/2012/058247, filed Oct. 1, 2012, which designated the United States and claimed priority to provisional U.S. patent application Ser. No. 61/541,779, filed Sep. 30, 2011. Each of these patent applications is entitled "Electrically Conductive Membrane Pump/Transducer And Methods To Make And Use Same."

This application is also related to U.S. patent application Ser. No. 15/017,452, entitled "Loudspeaker Having Electrically Conductive Membrane Transducers," filed Feb. 5, 2016, (the "Pinkerton '452 Application"), which claimed priority to provisional U.S. Patent Application Ser. No. 62/113,235, entitled "Loudspeaker Having Electrically Conductive Membrane Transducers," filed Feb. 6, 2015.

This application is also related to U.S. patent application Ser. No. 14/717,715, entitled "Compact Electroacoustic Transducer And Loudspeaker System And Method Of Use Thereof," filed May 20, 2015, (the "Pinkerton '715 Application").

All of these above-identified patent applications are commonly assigned to the Assignee of the present invention and are hereby incorporated herein by reference in their entirety for all purposes.

TECHNICAL FIELD

The present invention relates to loudspeakers, and in particular, to loudspeakers having an electrostatic transducer or an array of electrostatic transducers. The electrically conductive transducers generate the desired sound by the use of pressurized airflow.

BACKGROUND

Conventional audio speakers compress/heat and rarify/cool air (thus creating sound waves) using mechanical motion of a cone-shaped membrane at the same frequency as the audio frequency. Most cone speakers convert less than 10% of their electrical input energy into audio energy. These speakers are also bulky in part because large enclosures are used to muffle the sound radiating from the backside of the cone (which is out of phase with the front-facing audio waves). Cone speakers also depend on mechanical resonance; a large "woofer" speaker does not efficiently produce high frequency sounds, and a small "tweeter" speaker does not efficiently produce low frequency sounds.

Thermoacoustic (TA) speakers use heating elements to periodically heat air to produce sound waves. TA speakers do not need large enclosures or depend on mechanical resonance like cone speakers. However, TA speakers are terribly inefficient, converting well under 1% of their electrical input into audio waves.

The present invention relates to an improved loudspeaker that includes an array of electrically conductive membrane transducers such as, for example, an array of polyester-metal membrane pumps.

Graphene membranes (also otherwise referred to as "graphene drums") have been manufactured using a process such as disclosed in Lee et al. Science, 2008, 321, 385-388. PCT Patent Appl. No. PCT/US09/59266 (Pinkerton) (the "Pinkerton '266 PCT Application") described tunneling current switch assemblies having graphene drums (with graphene drums generally having a diameter between about 500 nm and about 1500 nm). PCT Patent Appl. No. PCT/US11/55167 (Pinkerton et al.) and PCT Patent Appl. No. PCT/US11/66497 (Everett et al.) further describe switch assemblies having graphene drums. PCT Patent Appl. No. PCT/US11/23618 (Pinkerton) (the "PCT US11/23618 Application") described a graphene-drum pump and engine system.

FIGS. 1-5 are figures that have been reproduced from FIGS. 27-32 of the Pinkerton '615 Application. As set forth in the Pinkerton '615 Application:

FIGS. 1A-1E depict an electrically conductive membrane pump/transducer 2700 that utilizes an array of electrically conductive membrane pumps that cause a membrane 2702 to move in phase. FIGS. 1A-1B are cross-sectional views of the pump/transducer that includes electrically conductive members 2701 (in the electrically conductive membrane pumps) and a speaker membrane 2702. Speaker membrane 2702 can be made of a polymer, such as PDMS. Each of the electrically conductive membrane pumps has a membrane 2701 that can deflect toward downward and upwards. Traces 2605 are a metal (like copper, tungsten, or gold). The electrically conductive membrane pumps also have a structural material 2703 (which can be plastic, FR4 (circuit board material), or Kapton® polyimide film (DuPont USA)) and support material 2704 that is an electrical insulator (like oxide, FR4, or Kapton® polyimide film). Support material 2704 can be used to support the pump membrane, support the stator and also serve as the vent structure. Integrating these functions into one element makes device 2700 more compact than it would be with multiple elements performing these functions. All of the non-membrane elements shown in FIG. 1A-1E can be made from printed circuit boards or die stamped sheets, which enhances manufacturability.

Arrows 2706 and 2707 show the direction of fluid flow (i.e., air flow) in the pump/transducer 2700. When the electrically conductive membranes 2701 are deflected downward (as shown in FIG. 1A), air will flow out of the pump/transducer device 2700 (from the electrically conductive membrane pumps) as shown by arrows 2706. Air will also flow from the cavity 2708 into the electrically conductive membrane pumps as shown by arrows 2707 resulting in speaker membrane 2702 moving downward. When the electrically conductive membranes 2701 are deflected upwards (as shown in FIG. 1B), air will flow into the pump/transducer device 2700 (into the electrically conductive membrane pumps) as shown by arrows 2706. Air will also flow into the cavity 2708 from the electrically conductive membrane pumps as shown by arrows 2707 resulting in speaker membrane 2702 moving upward.

FIG. 1C is an overhead view of pump/transducer device 2700. Line 2709 reflects the cross-section that is the viewpoint of cross-sectional views of FIGS. 1A-1B. FIGS. 1D-1E shows the flow of air (arrows 2707 and 2706, respectively) corresponding to the deflection downward of electrically conductive membranes 2701 and speaker membrane 2702 (which is shown in FIG. 1A). The direction of arrows 2707 and 2706 in FIGS. 1D-1E, respectively, are reversed when the deflection is upward (which is shown in FIG. 1B).

The basic operation for pump/transducer 2700 is as follows. A time-varying stator voltage causes the pump membranes 2701 to move and create pressure changes within the speaker chamber 2708. These pressure changes cause the speaker membrane 2702 to move in synch with the pump membranes 2701. This speaker membrane motion produces audible sound.

The ability to stack pumps in a compact way greatly increases the total audio power. Such a pump/transducer stacked system 2800 is shown in FIG. 2.

For the embodiments of the present invention shown in FIGS. 1A-1E and 2, the individual pump membranes 2701 can be smaller or larger than the speaker membrane 2702 and still obtain good performance.

Pump/transducer system 2700 (as well as pump/transducer speaker stacked system 2800) can operate at higher audio frequencies due to axial symmetry (symmetrical with respect to the speaker membrane 2702 center). Each membrane pump is approximately the same distance from the speaker membrane 2702 which minimizes the time delay between pump membrane motion and speaker membrane motion (due to the speed of sound) which in turn allows the pumps to operate at higher pumping/audio frequencies.

It also means that pressure waves from each membrane pump 2701 arrive at the speaker membrane 2702 at about the same time. Otherwise, an audio system could produce pressure waves that are out of synch (due to the difference in distance between each pump and the speaker membrane) and thus these waves can partially cancel (lowering audio power) at certain pumping/audio frequencies.

Pump/transducer system 2700 (as well as pump/transducer speaker stacked system 2800) further exhibit increased audio power. Since all the air enters/exits from the sides of the membrane pump, these pumps can be easily stacked (such as shown in FIG. 2) to significantly increase sound power. Increasing the number of pump stacks (also referred to "pump cards") from one to four (as shown in FIG. 2) increases audio power by approximately a factor of 16 As can be seen in FIG. 2, the gas within the chamber is sealed by the membrane pump membranes and the speaker membrane. The gas in the sealed chamber can be air or another gas such as sulfur hexafluoride that can withstand higher membrane pump voltages than air.

Audio output is approximately linear with electrical input (resulting in simpler/cheaper electronics/sensors). Another advantage of the design of pump/transducer 2700 is the way the pump membranes 2701 are charged relative to the gates/stators. These are referred to as "stators," since the term "gate" implies electrical switching. Pump/transducers have a low resistance membrane and the force between the stator and membrane is always attractive. This force also varies as the inverse square of the distance between the pump membrane and stator (and this characteristic can cause the audio output to be nonlinear/distorted with respect to the electrical input). The membrane can also go into "runaway" mode and crash into the stator. Thus, in practice, the amplitude of the membrane in pump/transducer is limited to less than half of its maximum travel (which lowers pumping speed and audio power).

The issues resulting from non-linear operation are solved in the design of pump/transducer 2700 by using a high resistance membrane (preferably a polymer film like Mylar with a small amount of metal vapor deposited on its surface) that is charged by a DC voltage and applying AC voltages to both stators (one stator has an AC voltage that is 180 degrees out of phase with the other stator). A high value resistor (on the order of $10^8$ ohms) may also be placed between the high resistance membrane (on the order of $10^6$ to $10^{12}$ ohms per square) and the source of DC voltage to make sure the charge on the membrane remains constant (with respect to audio frequencies).

Because the pump membrane 2701 has relatively high resistance (though low enough to allow it to be charged in several seconds) the electric field between one stator and the other can penetrate the charged membrane. The charges on the membrane interact with the electric field between stator traces to produce a force. Since the electric field from the stators does not vary as the membrane moves (for a given stator voltage) and the total charge on the membrane remains constant, the force on the membrane is constant (for a give stator voltage) at all membrane positions (thus eliminating the runaway condition and allowing the membrane to move within its full range of travel). The electrostatic force (which is approximately independent of pump membrane position) on the membrane increases linearly with the electric field of the stators (which in turn is proportional to the voltage applied to the stators) and as a result the pump membrane motion (and also the speaker membrane 2702 that is being driven by the pumping action of the pump membrane 2701) is linear with stator input voltage. This linear link between stator voltage and pump membrane motion (and thus speaker membrane motion) enables a music voltage signal to be routed directly into the stators to produce high quality (low distortion) music.

FIG. 3 depicts an electrically conductive membrane pump/transducer 3000 that is similar to the pump/transducers 2700 and 2900, in that it utilizes an array of electrically conductive membrane pumps. Pump/transducer 3000 does not utilize a speaker membrane (such as in pump/transducer 2700) or a structure in place of the speaker membrane (such as in pump/transducer 2900). Pump/transducer 3000 produces substantial sound even without a speaker membrane. Applicant believes the reason that there is still good sound power is that the membrane pumps are compressing the air as it makes its way out of the inner vents (increasing the pressure of an time-varying air stream increases its audio power). Arrows 3001 show the flow of air through the inner vents. The pump/transducer 3000 has a chamber that receives airflow 3001 and this airflow exhausts out the chamber by passing through the open area (the chamber exhaust area) at the top of the chamber. In order to produce substantial sound the total area of the membrane pumps must be at least 10 times larger than the chamber exhaust area.

FIG. 3 also shows an alternate vent configuration that has holes 3003 in the stators that allow air to flow to separate vent layers. The cross-sectional airflow area of the vents (through which the air flow is shown by arrows 3001) is much smaller than the pump membrane area (so that the air is compressed). FIG. 3 also shows how a simple housing 3004 can direct the desired sound 3005 toward the listener (up as shown in FIG. 3) and the undesired out of phase sound away from the listener (down as shown in FIG. 3). The desired sound 3005 is in the low sub-woofer range to mid-range (20 Hz to about 3000 Hz).

FIG. 4 depicts an electrically conductive membrane pump/transducer 3100 that is the pump/transducer 3000 that also includes an electrostatic speaker 3101 (which operates as a "tweeter"). An electrostatic speaker is a speaker design in which sound is generated by the force exerted on a membrane suspended in an electrostatic field. The desired sound 3102 from the electrostatic speakers 3101 is in a frequency in the range of around 2 to 20 KHz (generally considered to be the upper limit of human hearing). Accordingly, pump/transducer 3100 is a combination system that includes a low/mid-range speaker and a tweeter speaker.

FIG. 5 depicts an electrically conductive membrane pump/transducer 3200 that is the pump/transducer 3100 that further includes the speaker membrane 3202 (such as in pump/transducer 2700).

FIGS. 6A-6C and 7 are figures that have been reproduced from FIGS. 16A-16C and 17 of the Pinkerton '715 Application. As set forth in the Pinkerton '715 Application:

FIG. 6A illustrates an electroacoustic transducer 1601 ("ET," which can also be referred to as a "pump card") and its solid stator 1602 (shown in more detail in FIG. 6B). Vent fingers 1603 are also shown in ET 1601. FIG. 6B is a magnified view of ET 1601 and shows how there are membranes 1604 and 1605 on each side of shared stator 1602.

FIG. 6C shows the electroacoustic transducer 1601 having a single stator card before trimming off the temporary support 1606 that supports the vent fingers 1603 (as shown in FIGS. 6A-6B). This process enables a low cost die stamping construction. Parts can be stamped out (which is very low cost), then epoxied together, and then the part 1606 that temporarily holds all the vent fingers 1603 in place can be quickly stamped off or trimmed off.

FIG. 7 is an exploded view of ET 1601. From top to bottom: FIG. 7 shows an electrically conductive membrane 1604, a first metal frame 1701, first non-conductive vent member 1702 (with its 23 vent fingers 1703), solid metal stator 1602, second non-conductive vent member 1704, and second metal frame 1705. (The second membrane is not shown). These parts can be joined together with epoxy, double-sided tape, sheet adhesive or any other suitable bonding process. After membrane 1604 is bonded to frame 1701 its entire outside edge (peripheral edge) is supported by frame 1701.

SUMMARY OF THE INVENTION

The present invention relates to a loudspeaker having an improved pump cards that each include an array of electrically conductive membrane transducers (such as polyester-metal membrane pumps). The array of electrically conductive membrane transducers combine to generate the desired sound by the use of pressurized airflow. These are improved over the earlier pump cards in that they do not have the frames, and are now supported by a pair of vent members.

In general, in one aspect, the invention features an electroacoustic transducer that includes a pair of pump cards. The pair of pump cards includes a first vent member having a first side, wherein the first vent member has a plurality of first vent fingers. The pair of pump cards further includes a first electrically conductive membrane having a first side and a second side. The first side of the first vent member is on the first side of the first electrically conductive membrane. The first electrically conductive membrane is movable along a first axis. The plurality of first vent fingers are arranged so that air can flow between the plurality of first vent fingers along a second axis. The first axis and the second axis are substantially perpendicular. The pair of pump cards further includes a second vent member having a first side and a second side. The first side of the second vent member is on the second side of the first electrically conductive membrane. The second vent member has a plurality of second vent fingers. The plurality of second vent fingers are arranged so that air can flow between the plurality of second vent fingers along the second axis. The pair of pump cards further includes a first electrically conductive stator having a first side and a second side. The second side of the second vent member is on the first side of the first electrically conductive stator. The pair of pump cards further includes a third vent member having a first side and a second side. The first side of the third vent member is on the second side of the first electrically conductive stator. The third vent member has a plurality of third vent fingers. The pair of pump cards further includes a second electrically conductive membrane having a first side and a second side. The second side of the third vent member is on the first side of the second electrically conductive membrane. The second electrically conductive membrane is movable along the first axis. The plurality of third vent fingers are arranged so that air can flow between the plurality of third vent fingers along the second axis. The pair of pump cards further includes a fourth vent member having a first side and a second side. The first side of the fourth vent member is on the second side of the second electrically conductive stator. The fourth vent member has a plurality of fourth vent fingers. The plurality fourth vent fingers are arranged so that air can flow between the plurality of fourth vent fingers along the second axis.

Implementations of the invention can include one or more of the following features:

The pair of pump cards can be supported by the first vent member, the second vent member, the third vent member, and the fourth vent member in the absence of a frame to support the pair of pump cards.

The total thickness of the electroacoustic transducer can be less than 4 mm.

The total thickness of the electroacoustic transducer can be less than 2 mm.

The electroacoustic transducer has a total thickness and the first electrically conductive membrane and the second electrically conductive membrane can each have a peak amplitude that exceeds 20% of the total thickness of the electroacoustic transducer.

The electroacoustic transducer has a total thickness and the first electrically conductive membrane and the second electrically conductive membrane can each have a peak amplitude that exceeds 40% of the total thickness of the electroacoustic transducer.

The electroacoustic transducer can further include a first insulating film bonded to the first side of the first electrically conductive stator and the second side of the first electrically conductive stator. The electroacoustic transducer can further include a second insulating film bonded to the first side of the second electrically conductive stator and the second side of the second electrically conductive stator.

The first electrically conductive stator and the second first electrically conductive stator can each include metal.

The metal can include stainless steel.

The first electrically conductive stator can be between 1 cm and 5 cm wide. The second electrically conductive stator can be between 1 cm and 5 cm wide.

The first electrically conductive stator can have a thickness between 10 μm and 100 μm. The second electrically conductive stator can have a thickness between 10 μm and 100 μm.

Each of the first vent member, the second vent member, the third vent member, and the fourth vent member can be an electrical insulator.

Each of the first vent member, the second vent member, the third vent member, and the fourth vent member can include fiberglass.

The thickness of each of the first vent member, the second vent member, the third vent member, and the fourth vent member can be between 0.1 mm and 1 mm.

The plurality of the first vent fingers can be between 5 and 50 first vent fingers. The plurality of the second vent fingers can be between 5 and 50 second vent fingers. The plurality of the third vent fingers can be between 5 and 50 first vent fingers. The plurality of the fourth vent fingers can be between 5 and 50 second vent fingers.

Each of the first vent member, the second vent member, the third vent member, and the fourth vent member can be translucent.

Each of the first vent member, the second vent member, the third vent member, and the fourth vent member can be optically transparent.

In general, in another aspect, the invention features a loudspeaker that includes a stack of a plurality of electroacoustic transducers. At least some of the electroacoustic transducers in the plurality of electroacoustic transducers each include a pair of pump cards. The pair of pump cards includes a first vent member having a first side, wherein the first vent member has a plurality of first vent fingers. The pair of pump cards further includes a first electrically conductive membrane having a first side and a second side. The first side of the first vent member is on the first side of the first electrically conductive membrane. The first electrically conductive membrane is movable along a first axis. The plurality of first vent fingers are arranged so that air can flow between the plurality of first vent fingers along a second axis. The first axis and the second axis are substantially perpendicular. The pair of pump cards further includes a second vent member having a first side and a second side. The first side of the second vent member is on the second side of the first electrically conductive membrane. The second vent member has a plurality of second vent fingers. The plurality of second vent fingers are arranged so that air can flow between the plurality of second vent fingers along the second axis. The pair of pump cards further includes a first electrically conductive stator having a first side and a second side. The second side of the second vent member is on the first side of the first electrically conductive stator. The pair of pump cards further includes a third vent member having a first side and a second side. The first side of the third vent member is on the second side of the first electrically conductive stator. The third vent member has a plurality of third vent fingers. The pair of pump cards further includes a second electrically conductive membrane having a first side and a second side. The second side of the third vent member is on the first side of the second electrically conductive membrane. The second electrically conductive membrane is movable along the first axis. The plurality of third vent fingers are arranged so that air can flow between the plurality of third vent fingers along the second axis. The pair of pump cards further includes a fourth vent member having a first side and a second side. The first side of the fourth vent member is on the second side of the second electrically conductive stator. The fourth vent member has a plurality of fourth vent fingers. The plurality fourth vent fingers are arranged so that air can flow between the plurality of fourth vent fingers along the second axis.

Implementations of the invention can include one or more of the following features:

The pair of pump cards can be supported by the first vent member, the second vent member, the third vent member, and the fourth vent member in the absence of a frame to support the pair of pump cards The stack of a plurality of electroacoustic transducers can be a parallel stack of electroacoustic transducers.

The stack of the plurality of electroacoustic transducers can have between 10 and 200 electroacoustic transducers.

The loudspeaker can further include a metal grill and a plurality of electronic components that are at least partially in thermal contact with the metal grill.

The loudspeaker can further include a metal grill and a plurality of electronic components that are at least partially in thermal contact with the metal grill. The operation of the stack can create airflow through the metal grill that indirectly cools an electronic component.

The stack can serve as its own baffle.

The first electrically conductive membranes and the second electrically conductive membranes in the stack can have a total area that is at least 10 times larger than the total face area of the first, second, third and fourth vent members.

The stack can be less than 30 centimeters tall.

In general, in another aspect, the invention features a method of manufacturing electroacoustic transducer card stacks. The method includes the step of forming a plurality of panel stacks. The step of forming a panel stack in the plurality of panel stacks includes bonding a first side of an electrically conductive stator panel including a plurality of electrically conductive stators to a first side of a first vent member panel including a plurality of first vent members. The step of forming a panel stack in the plurality of panel stacks further includes bonding a first side of the electrically conductive membrane to the second side of the first vent member panel while maintaining the electrically conductive membrane under tension. The step of forming a panel stack in the plurality of panel stacks further includes bonding a first side of a second vent member panel to the second side of the electrically conductive membrane.

Implementations of the invention can include one or more of the following features:

The electrically conductive stator panel can include at least 10 electrically conductive stators. The first vent member panel can include at least 10 first vent members. The second vent member panel can include at least 10 second vent members. The step of cutting the bonded stack of panel stacks to create the plurality of electroacoustic transducer card stacks can create at least 10 electroacoustic transducer cards.

The bonding can include bonding with epoxy.

The method can further include curing the epoxy before the step of cutting the bonded stack of panel stacks.

Each of the first vent members in the plurality of first vent member panels and each of the second vent members in the plurality of second vent member panels can be an electrical insulator.

Each of the first vent members in the plurality of first vent member panels and each of the second vent members in the plurality of second vent member panels can include fiberglass.

The thickness of each of the first vent members in the plurality of first vent member panels and each of the second vent members in the plurality of second vent member panels can be between 0.1 mm and 1 mm.

The step of bonding the first side of the electrically conductive membrane to the second side of the first vent member panel can include applying a force to the electrically conductive membrane to maintain the electrically conductive membrane under tension. Before the step of bonding the first side of the second vent member panel to the second side of the electrically conductive membrane, the application of the force to the electrically conductive membrane can be discontinued.

After the application of the force to the electrically conductive membrane is discontinued and before the step of bonding the first side of the second vent member panel to the second side of the electrically conductive membrane, the electrically conductive membrane can be cut to remove any excess electrically conductive material.

The step of forming plurality of panel stacks can occur in the absence of bonding a frame to the panel of stacks in the plurality of panel stacks.

The method can further include the step of stacking and bonding the panel stacks in the plurality of panel stacks to form a bonded stack of panel stacks. For adjacent panel stacks in the bonded stack of panel stacks, the second side of the second vent member panel of a first adjacent panel stack in the two adjacent panel stacks can be bonded to the second side of the electrically conductive stator panel of a second adjacent panel stack in the two adjacent panel stacks.

The step of stacking and bonding the panel stacks in the plurality of panel stacks can include stacking and bonding at least 10 panel stacks.

The step of stacking and bonding the panel stacks in the plurality of panel stacks can include stacking and bonding at least 20 panel stacks.

The method can further include the step of cutting the bonded stack of panel stacks to create a plurality of electroacoustic transducer card stacks. The conductive membranes can be each movable along a first axis. The cutting of the bonded stack of panel stack can cut the first vent member panel to form a plurality of first vent fingers arranged so that air can flow between the plurality of first vent fingers along a second axis. The first axis and the second axis can be substantially perpendicular.

The cutting of the bonded stack of panel stack can cut the second vent member panel to form a plurality of second vent fingers arranged so that air can flow between the plurality of second vent fingers along the second axis.

The method can further include stacking and bonding at least some of the plurality of the electroacoustic transducer card stacks after the step of cutting.

The step of stacking and bonding at least some of the plurality of the electroacoustic transducer card stacks can include stacking and bonding at least 10 electroacoustic transducer card stacks.

The electrically conductive stator panel can include at least 14 electrically conductive stators. The first vent member panel can include at least 14 first vent members. The second vent member panel can include at least 14 second vent members. The step of cutting the bonded stack of panel stacks to create the plurality of electroacoustic transducer card stacks can create at least 14 electroacoustic transducer cards.

The step of forming the plurality of panel stacks can further include bonding an insulating film bonded to the first side of the electrically conductive stators in the electrically conductive stator panels and the second side of the electrically conductive stators in the electrically conductive stator panels.

The insulating film can be bonded using a thermal laminator.

The electrically conductive stators in the electrically conductive stator panels can each include metal.

The metal can include stainless steel.

The step of cutting the bonded stack of panel stacks to create the plurality of electroacoustic transducer card stacks can create the plurality of electroacoustic transducer card stacks having electrically conductive stators between 1 cm and 5 cm wide.

The step of cutting the bonded stack of panel stacks to create the plurality of electroacoustic transducer card stacks can create the plurality of electroacoustic transducer card stacks having electrically conductive stators that each has a thickness between 10 μm and 100 μm.

For each of the electroacoustic transducer cards in the electroacoustic transducer card stacks in the plurality of electroacoustic transducer card stacks, the plurality of the first vent fingers in the electroacoustic transducer card has can be between 5 and 50 first vent fingers. For each of the electroacoustic transducer cards in the electroacoustic transducer card stacks in the plurality of electroacoustic transducer card stacks, the plurality of the second vent fingers in the electroacoustic transducer card can be between 5 and 50 second vent fingers.

Each of the first vent member panels and each of the second vent member panels can be translucent.

Each of the first vent member panels and each of the second vent member panels can be optically transparent.

The electrically conductive membranes can be subjected to an antistatic process using an alpha particle emitter before or during the step of forming a plurality of panel stacks.

The method can further include cutting each of the panel stacks in the plurality of panel stacks to create a plurality of electroacoustic transducer cards. For each panel stack, the conductive membranes can each be movable along a first axis. For each panel stack, the cutting of the panel stack can cut the first vent member panel to form a plurality of first vent fingers arranged so that air can flow between the plurality of first vent fingers along a second axis. For each panel stack, the first axis and the second axis can be substantially perpendicular.

The cutting of the panel stack can cut the second vent member panel to form a plurality of second vent fingers arranged so that air can flow between the plurality of second vent fingers along the second axis.

The method can further include stacking at least some of the plurality of the electroacoustic transducer cards after the step of cutting to form an electroacoustic transducer card stack.

The electroacoustic transducer cards in the electroacoustic transducer card stack can be bonded together.

The electroacoustic transducer cards in the electroacoustic transducer card stack can be mechanically clamped together.

In general, in another aspect, the invention features an electroacoustic transducer card panel that includes a first vent panel that includes a plurality of first vent members and a plurality of first vent member panel alignment holes. The electroacoustic transducer card panel further includes a plurality of stator members that each include a plurality of stator member alignment holes. At least some of the plurality of first vent member alignment holes are in alignment with at least some of the stator member alignment holes. The stator members are bonded to a first side of the first vent panel. The electroacoustic transducer card panel further includes an electrically conductive membrane. A first side of the electrically conductive membrane is bonded to a second side of the first vent panel. The electroacoustic transducer card panel further includes a second vent panel that includes a plurality of second vent members and a plurality of second vent member alignment holes. A second side of the electrically conductive membrane is bonded to a first side of the second vent panel.

Implementations of the invention can include one or more of the following features:

Each of the first vent panel and the second vent panel can be an electrical insulator.

Each of the first vent panel and the second vent panel can include fiberglass.

Each of the stator members can include metal.

The metal can include stainless steel.

Each of the stator members can be encapsulated in an electrically insulating material.

The electrically conductive membrane can be bonded to the first vent panel under tension.

In general, in another aspect, the invention features a method that include selecting any of the above-described electroacoustic transducer card panels. The method further include cutting the electroacoustic transducer card panel to form a plurality of electroacoustic transducer cards.

Implementations of the invention can include one or more of the following features:

The method can further include stacking the plurality of electroacoustic transducer cards to form an electroacoustic transducer card stack.

The method can further including bonding adjacent electroacoustic transducer cards in the plurality of electroacoustic transducer cards.

The method can further include mechanically clamping the plurality of electroacoustic transducer cards stacked in the electroacoustic transducer card stack.

The method can further include selecting a plurality of any of the above-described electroacoustic transducer card panels. The method can further include stacking and bonding the plurality of electroacoustic transducer card panels to form an electroacoustic transducer card panel stack. The step of cutting can include cutting the electroacoustic transducer card panel stack into a plurality of electroacoustic transducer card stacks. The electroacoustic transducer card stacks can include the plurality of electroacoustic transducer cards.

DESCRIPTION OF DRAWINGS

FIGS. 1A-1B depict cross-section views of the pump/transducer. FIGS. 1C-1E depict overhead views of the pump/transducer.

DETAILED DESCRIPTION

The present invention relates to a loudspeaker having an improved pump cards that each include an array of electrically conductive membrane transducers (such as polyester-metal membrane pumps). The array of electrically conductive membrane transducers combine to generate the desired sound by the use of pressurized airflow. These are improved over the earlier pump cards in that they do not have the frames, and are now supported by a pair of vent members.

Figure 1A:
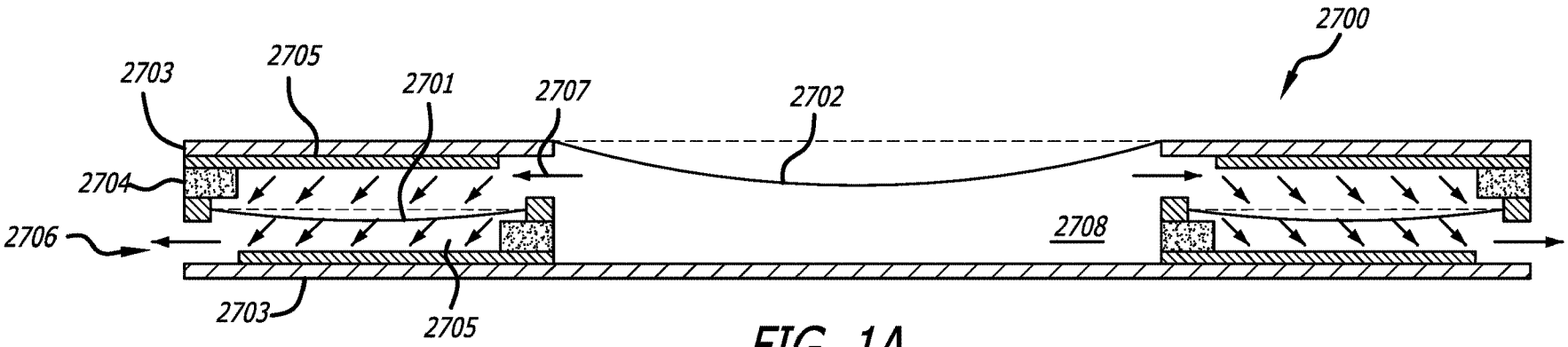
FIGS. 1A-1E (which are reproduced from the Pinkerton '615 Application) depict an electrically conductive membrane pump/transducer that utilizes an array of electrically conductive membrane pumps that cause a membrane to move in phase.
Figure 1B:
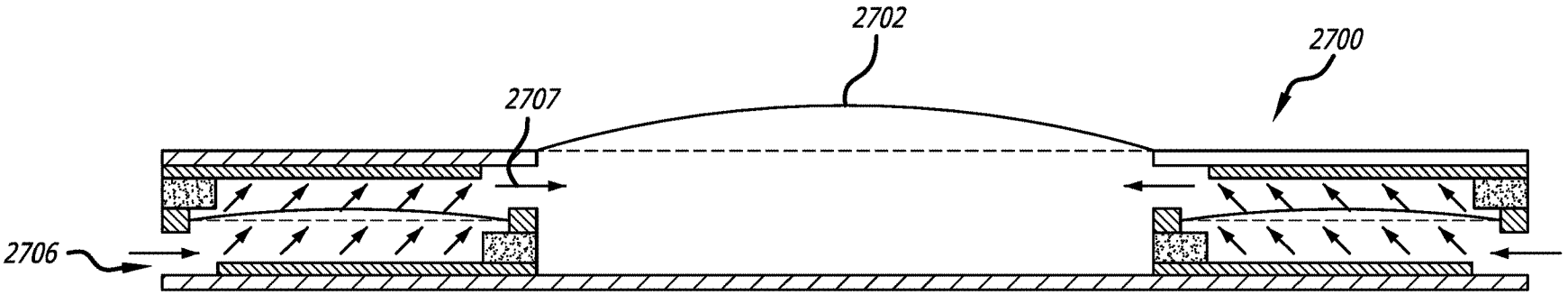
Figure 1C:
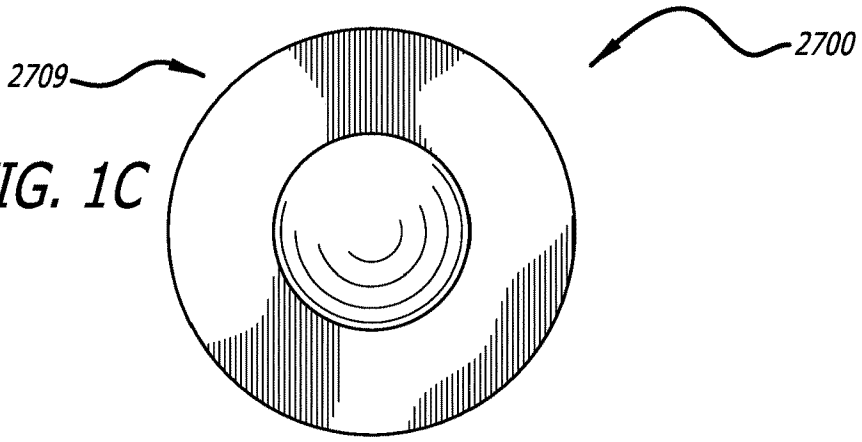
Figure 1E:
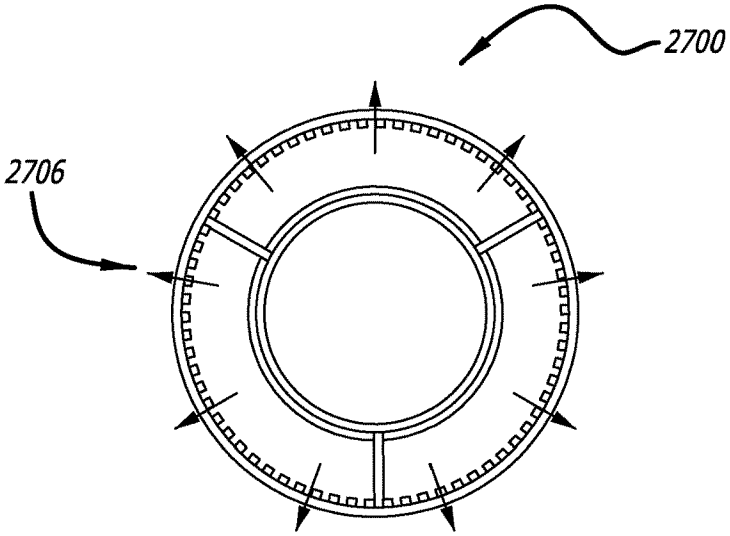
Figure 1D:
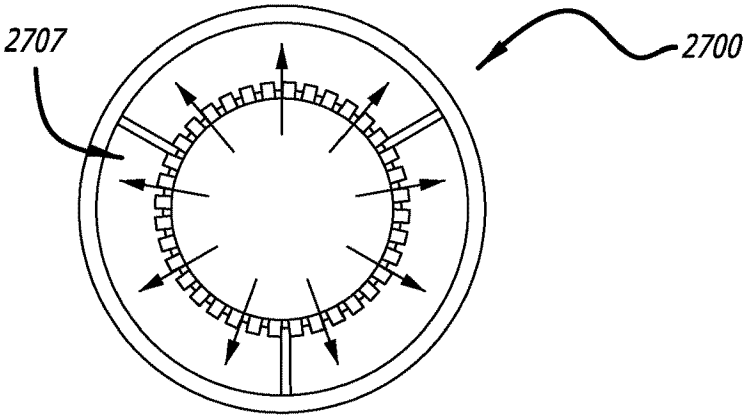
Figure 2:
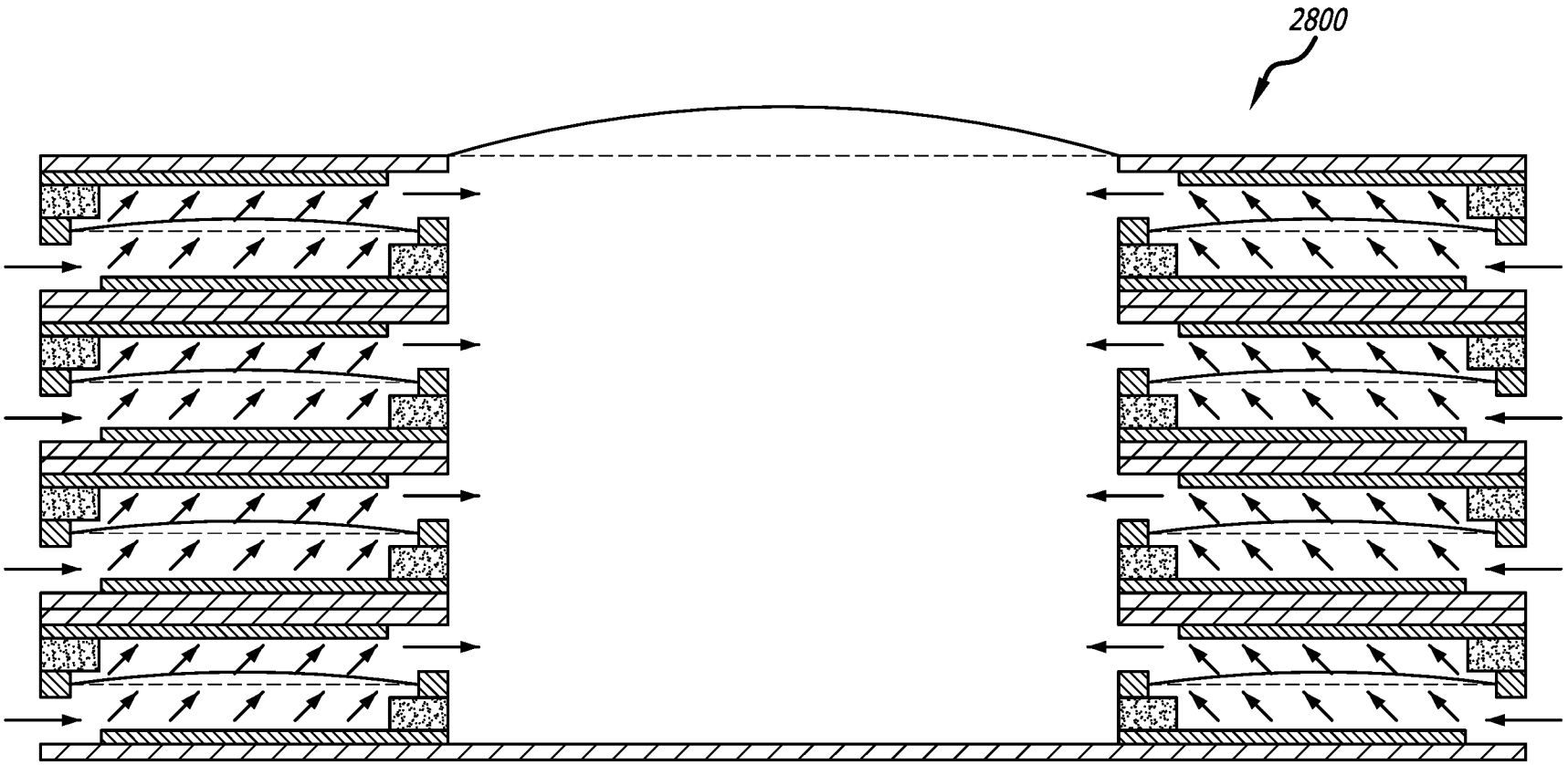
FIG. 2 (which is reproduced from the Pinkerton '615 Application) depicts an electrically conductive membrane pump/transducer that has a stacked array of electrically conductive membrane pumps.
Figure 3:
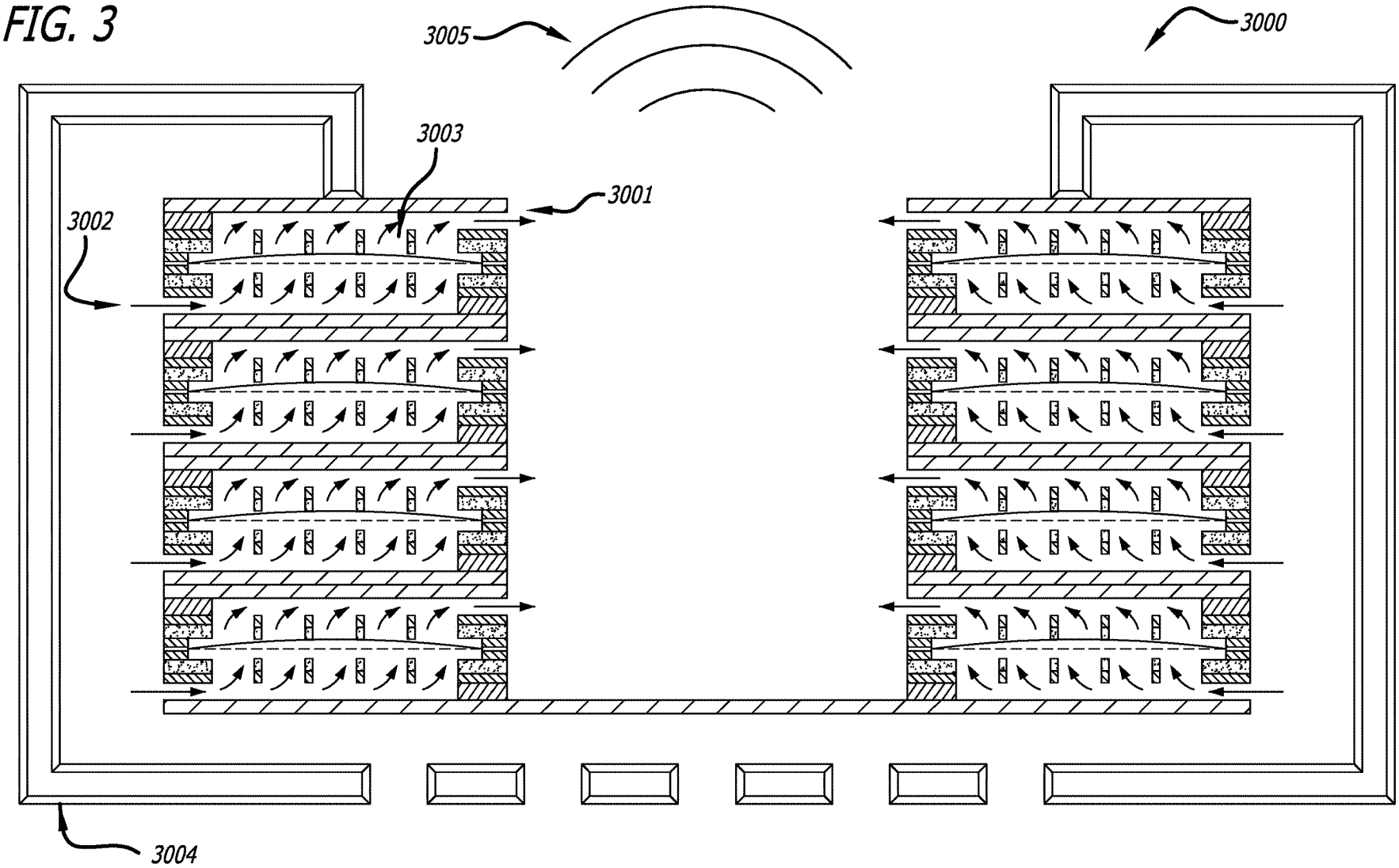
FIG. 3 (which is reproduced from the Pinkerton '615 Application) depicts an electrically conductive membrane pump/transducer that utilizes an array of electrically conductive membrane pumps that operates without a membrane or piston.
Figure 4:
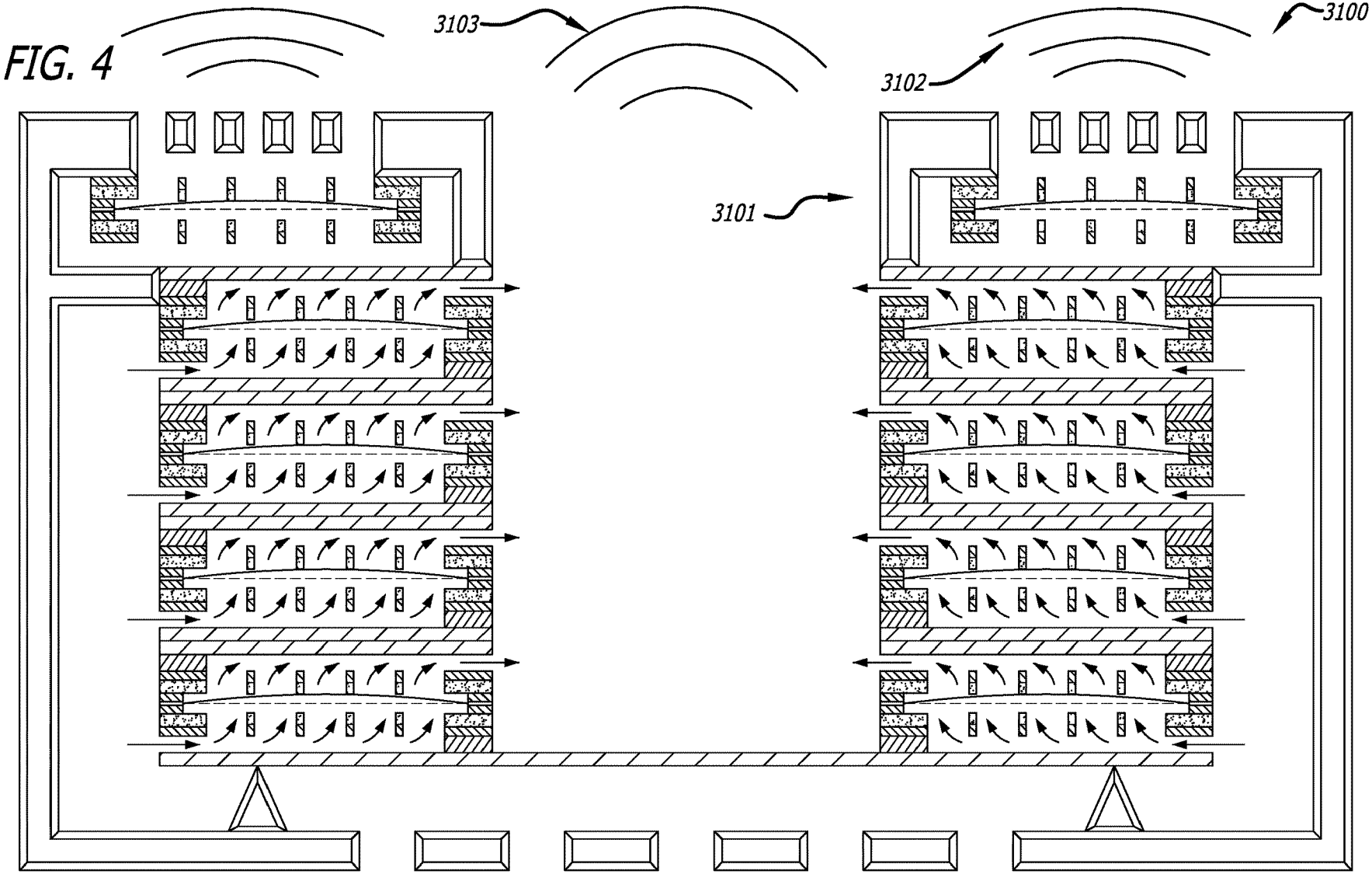
FIG. 4 (which is reproduced from the Pinkerton '615 Application) depicts an electrically conductive membrane pump/transducer 3100 that utilizes an array of electrically conductive membrane pumps and that also includes an electrostatic speaker.
Figure 5:
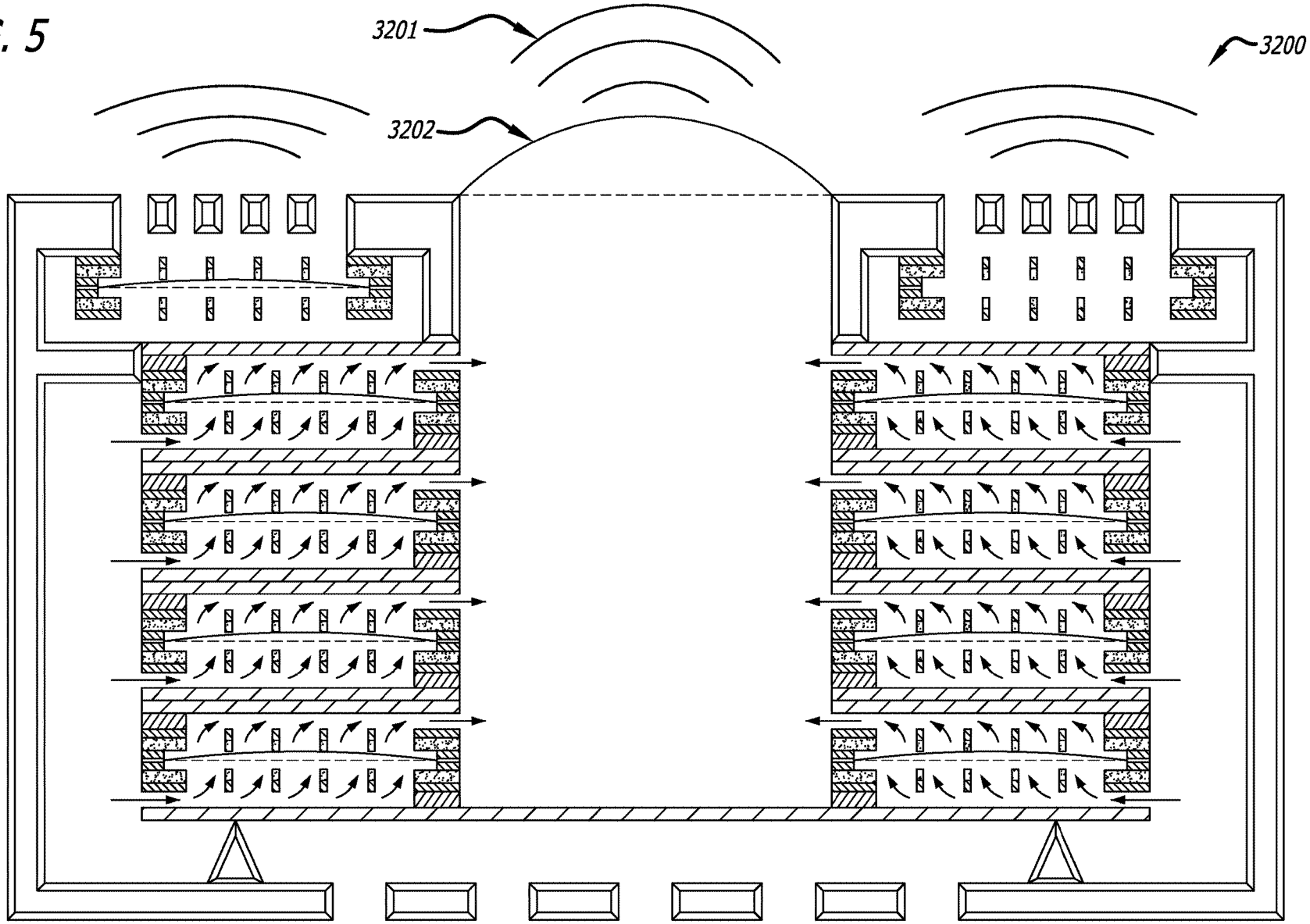
FIG. 5 (which is reproduced from the Pinkerton '615 Application) depicts an electrically conductive membrane pump/transducer 3200 that utilizes an array of electrically conductive membrane pumps that cause a membrane to move in phase and that also includes an electrostatic speaker.
Figure 6A:
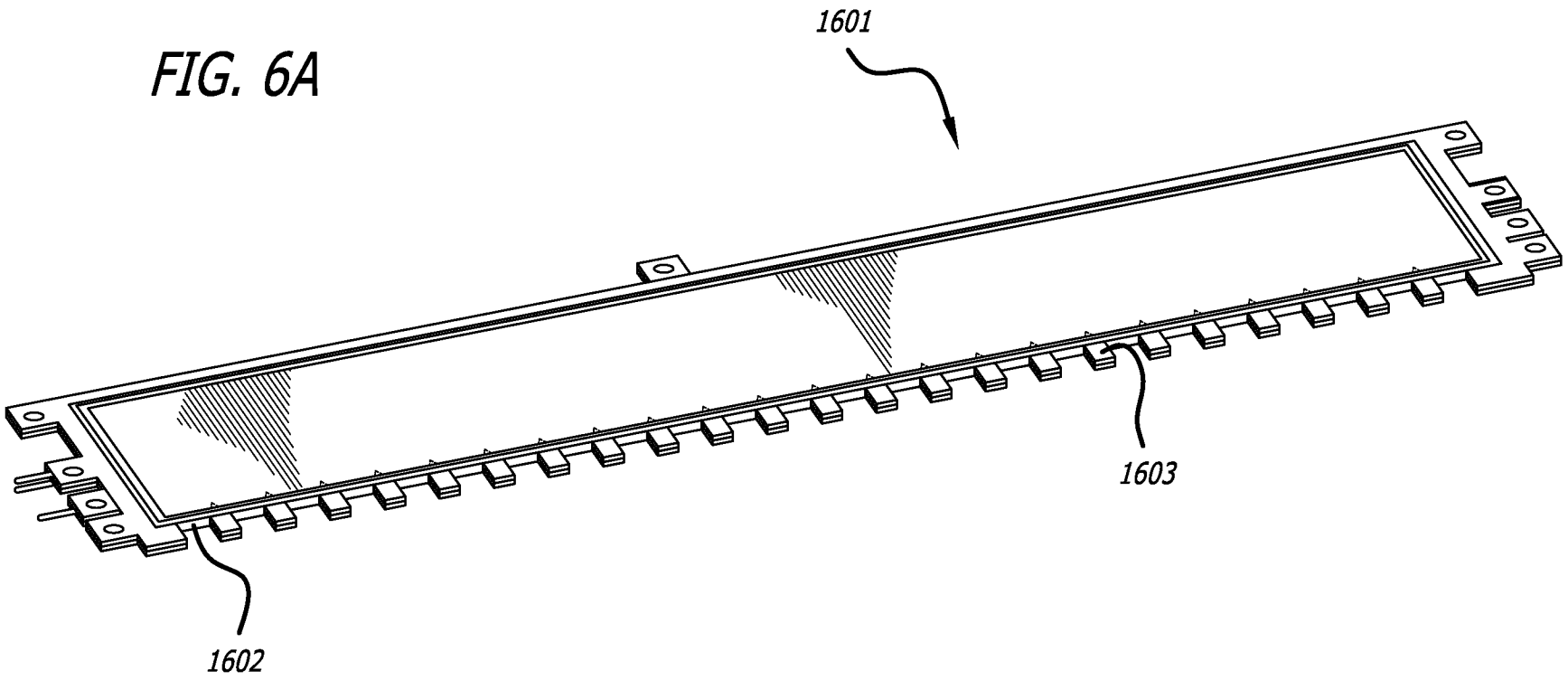
FIG. 6A (which is reproduced from the Pinkerton '715 Application) illustrates an electroacoustic transducer ("ET," which is also referred to as a "pump card") and its solid stator.
Figure 6B:
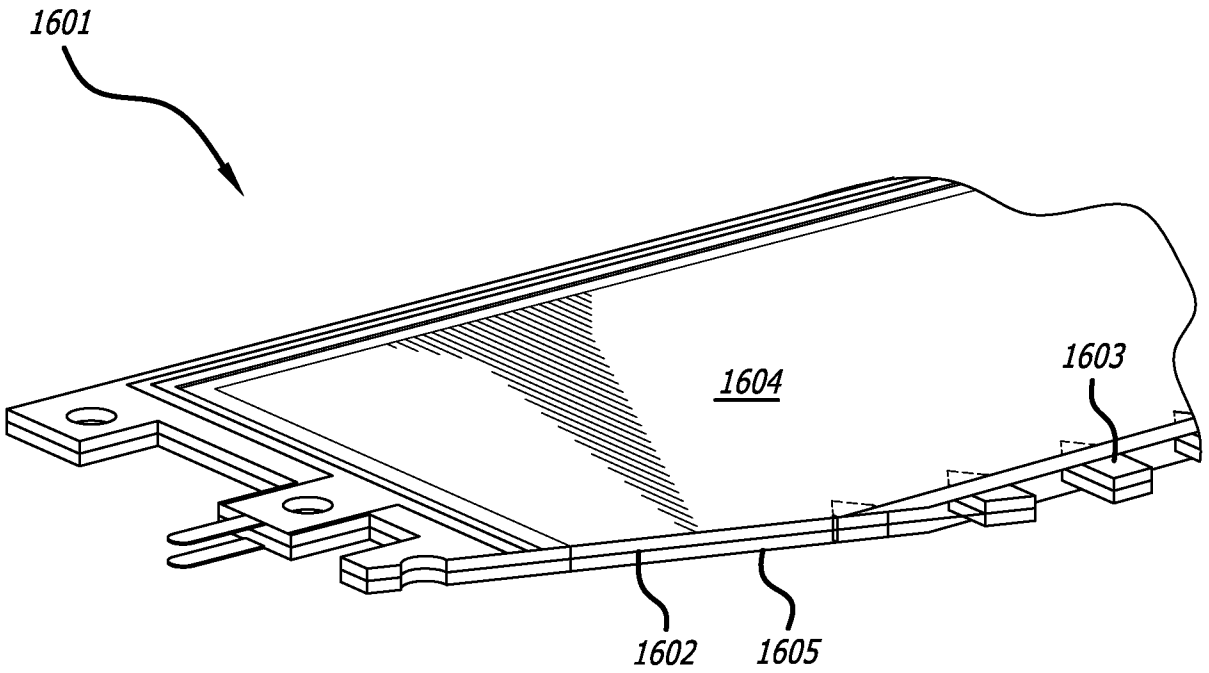
FIG. 6B (which is reproduced from the Pinkerton '715 Application) is a magnified view of the electroacoustic transducer of FIG. 6A.
Figure 6C:
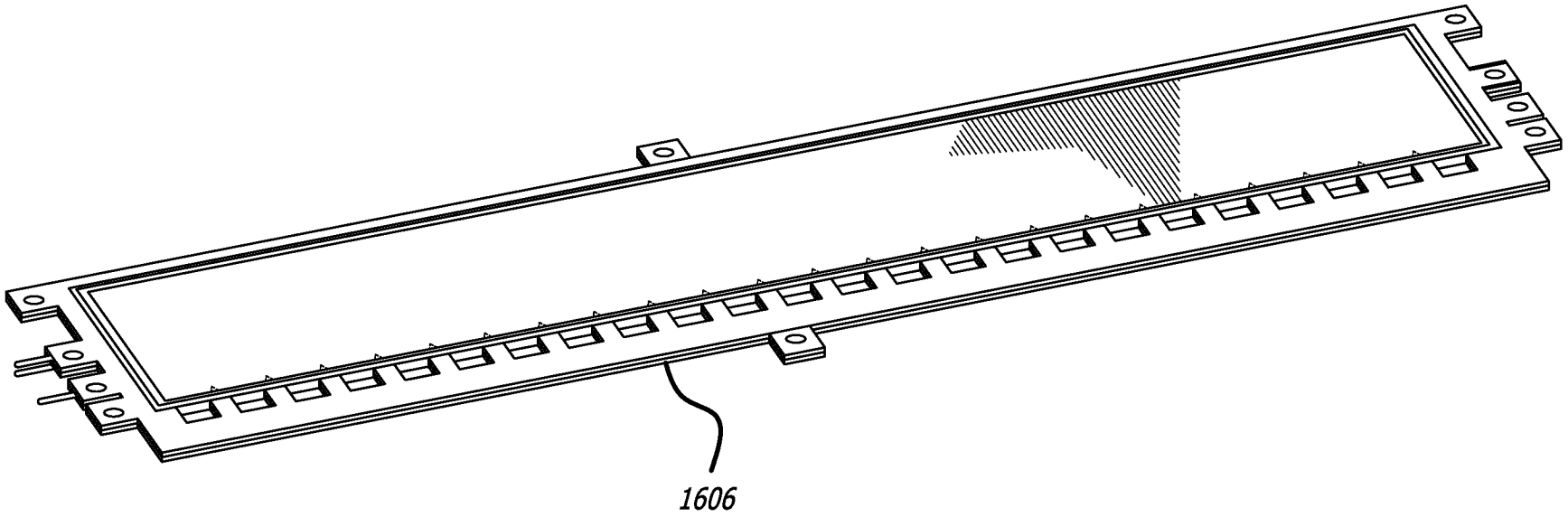
FIG. 6C (which is reproduced from the Pinkerton '715 Application) illustrates the electroacoustic transducer of FIG. 6A having a single stator card before trimming off the vent fingers.
Figure 7:
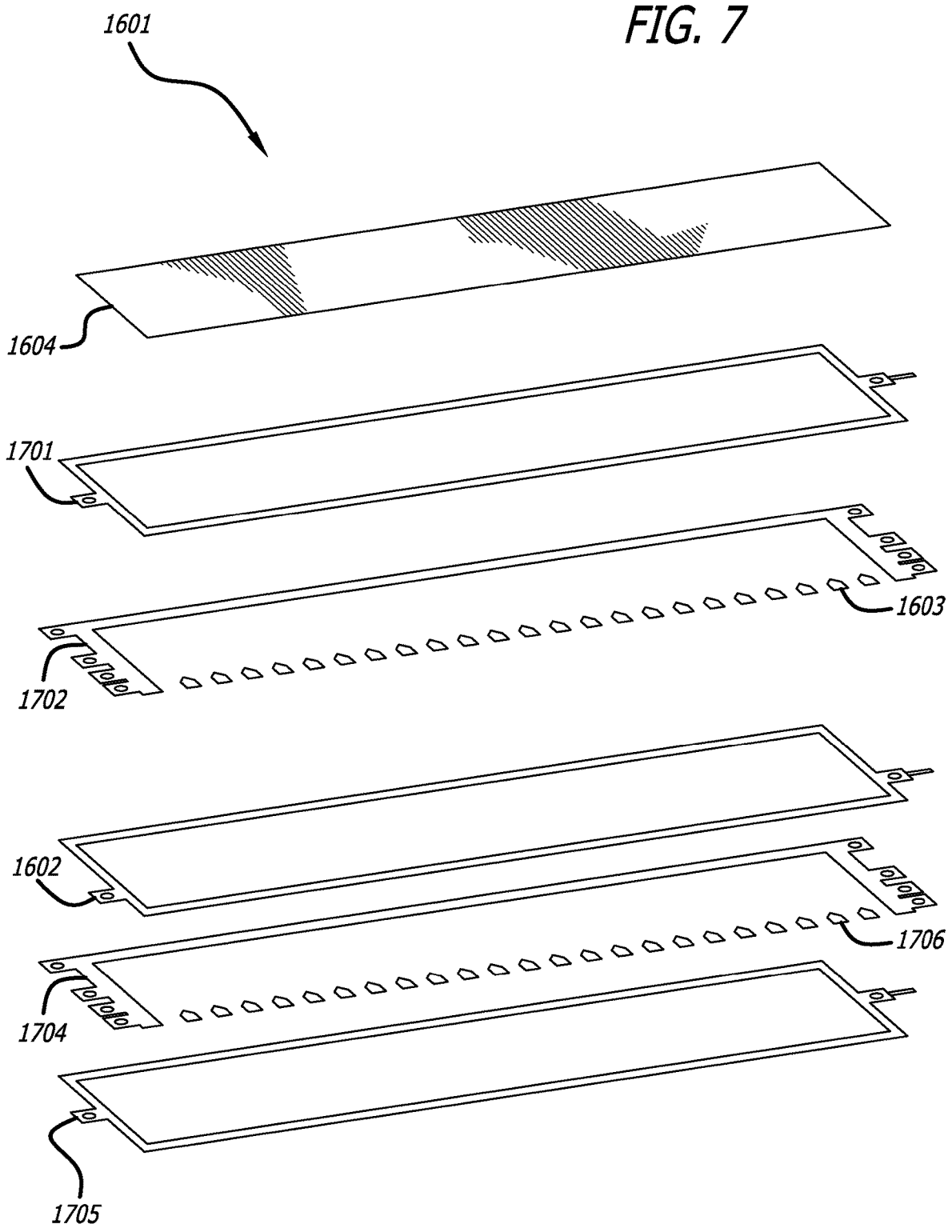
FIG. 7 (which is reproduced from the Pinkerton '715 Application) is exploded view of the electroacoustic transducer of FIG. 6A.
Figure 8A:
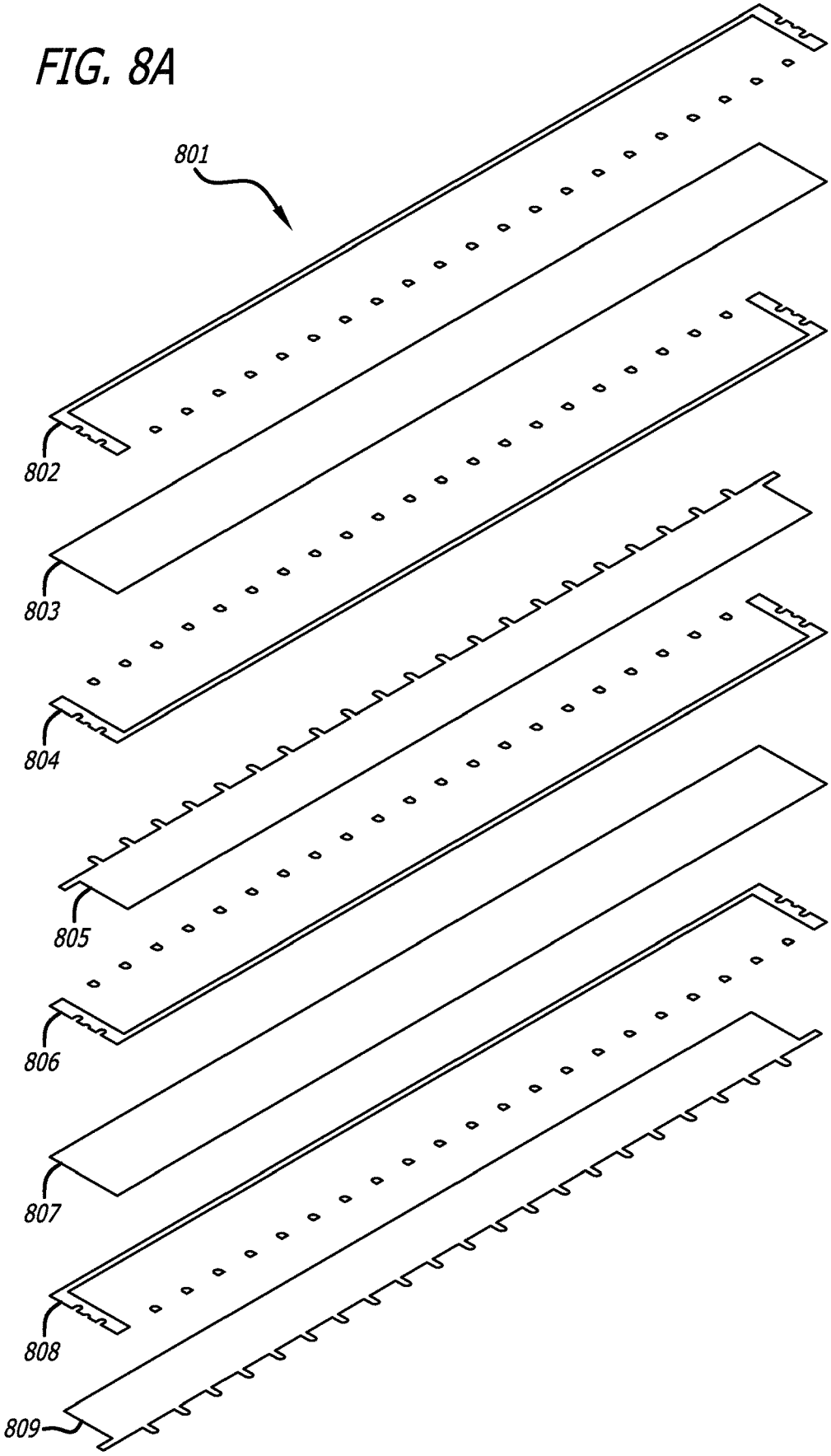
FIG. 8A illustrates an exploded view of an improved electroacoustic transducer of the present invention.

FIG. 8A illustrates an exploded view of an electroacoustic transducer 801 that has two pump cards. This is similar to the electroacoustic transducer 1601 shown in FIG. 7. However, electroacoustic transducer 801 does not have metal frames 1701 and 1705. I.e., the double stack cards of electroacoustic transducer 801 lack any frames.

Figure 8B:
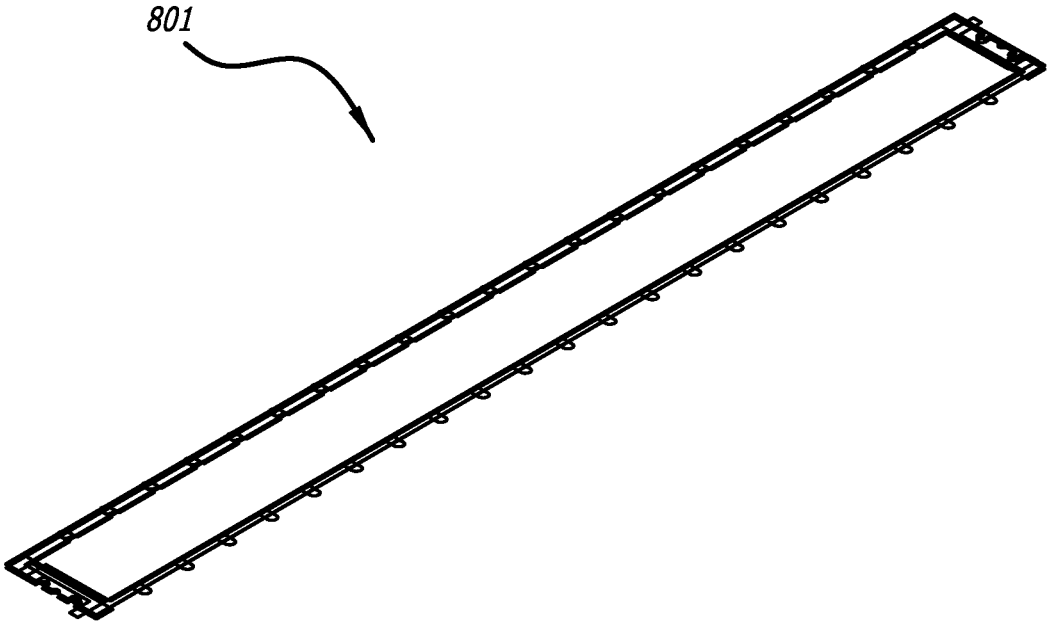
FIG. 8B illustrates the improved electroacoustic transducer shown in FIG. 8A in fabricated form.

From top to bottom: FIG. 8 shows a first non-conductive vent member 802 (with its 23 vent fingers), a first electrically conductive membrane 803, a second non-conductive vent member 804, a first solid metal stator 805, a third non-conductive vent member 806, a second electrically conductive membrane 807, a fourth non-conductive vent member 808, and a second solid metal stator 809. As before, these parts can be joined together with epoxy, double-sided tape, sheet adhesive or any other suitable bonding process. FIG. 8B shows the electroacoustic transducer 801 after its parts (as shown in FIG. 8A) have been bonded together.

The membranes (membranes 803 and 807) are supported by the pair of non-conductive vent membranes above and below the membrane. For example, first non-conductive vent member 802 supports a portion of a first electrically conductive membrane 803 and second non-conductive vent member 804 supports the other portion of first electrically conductive membrane 803. No non-conductive vent by itself can support the electrically conductive membrane.

This absence of the frames from electroacoustic transducer 801 was significant and provided advantageous and unexpected results. The frames in the earlier pump cards (such as the electroacoustic transducer 1601 shown in FIG. 7) were expensive, difficult to make (the metal spans being both thin and narrow) and also had a tendency of causing electrical arcs to the stator. By removing the frames, the electrical arcing has been eliminated in electroacoustic transducer 801.

Figure 9:
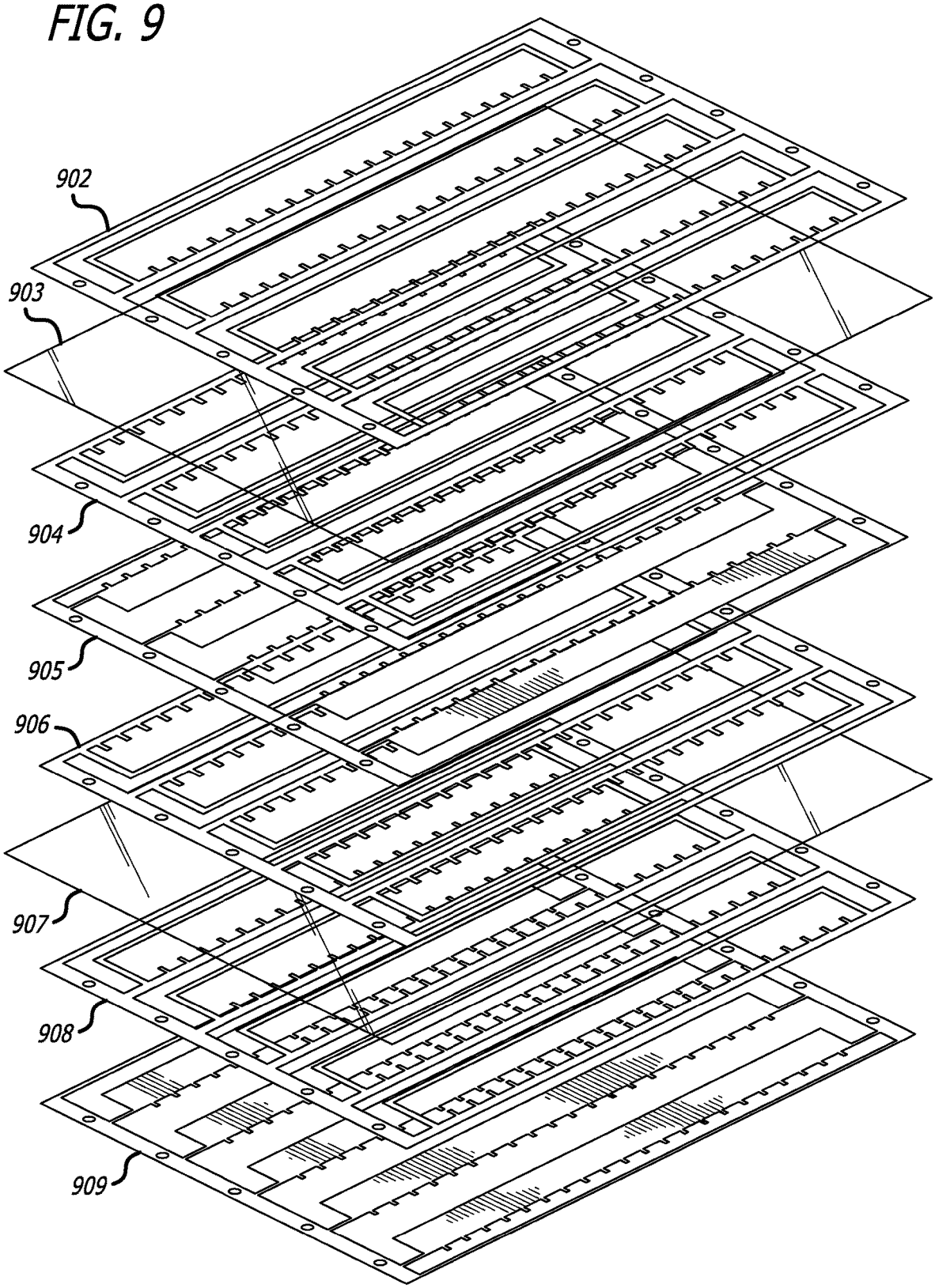
FIG. 9 illustrates panels that can be used in a process by which the improved electroacoustic transducer of the present invention can be manufactured.

FIG. 9 illustrates panels that can be used in a process by which the improved electroacoustic transducer of the present invention can be manufactured.

Panels 902, 904, 906, and 908 (which can also be referred to as "vent panels"), each contain a plurality of non-conductive vent members on them that are properly aligned. As illustrated in FIG. 9, there are five sets of non-conductive vent members per panel.

Panels 905 and 909 (which can also be referred to as "stator panels"), each contain a plurality of solid metal stators that are aligned similar to non-conductive vent members of panels 902, 904, 906, and 908 so that when placed together the vent panels and stator panels align with one another.

Sheets 903 and 907 are membrane material.

The panels are aligned as shown in FIG. 9 and then bonded together (with the membranes being held in high tension).

Since cards without steel frames are mechanically weaker than cards with frames, the panels 902, 904-906, and 908-909 (particularly the wide portion of the outer frame of the panels) provide added strength during the manufacturing process by partially supporting the mechanical load of the highly tensioned membranes 903 and 907 as several layers of material are bonded together. Once several layers of panels have been built up and the epoxy has cured (giving each panel added strength), individual card stacks can be cut out of the panels and assembled into complete stacks. Such stacks have been described in the Pinkerton '488 Application, the Pinkerton '615 Application, and the Pinkerton '715 Application. For example, 10 card layers can be bonded in panel form before cutting the cards out of the panel (which produces five 10-card stacks). About 10 of these 10 card mini-stacks are then bonded together to make a complete 100 card stack.

Figure 10B:
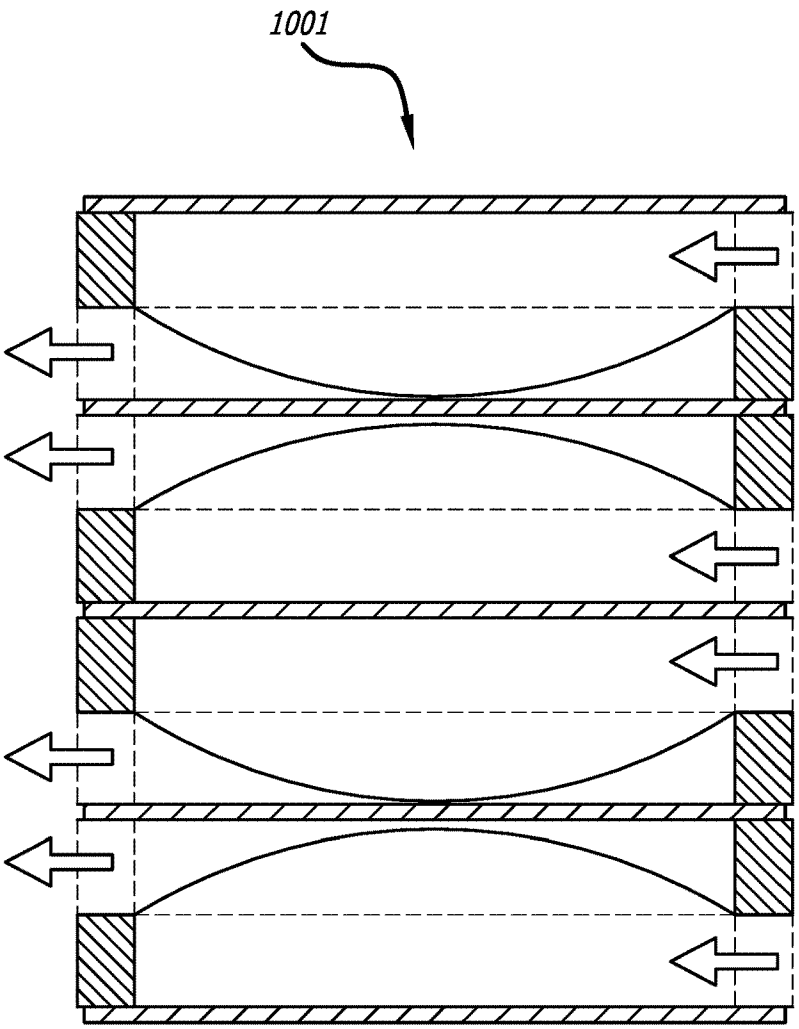
FIGS. 10A-10B illustrate a four-card stack of the improved electroacoustic transducers of the present invention and the airflow that results from membrane displacement.
Figure 10A:
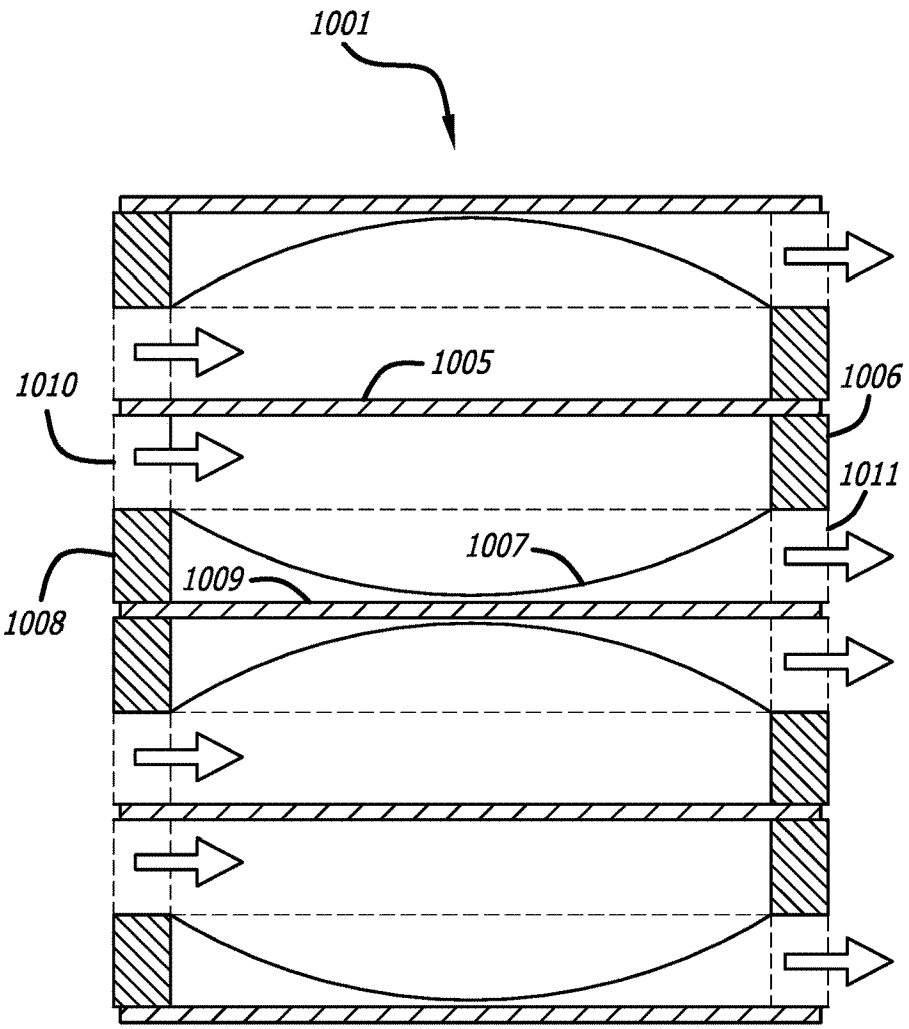

FIGS. 10A-10B illustrate a four-card stack 1001 of the improved electroacoustic transducers of the present invention and the airflow that results from membrane displacement. Focusing on the pump card that is the second from the top of four card stack 1001, this includes a first solid metal stator 1005, a first non-conductive vent member 1006, a first electrically conductive membrane 1007, a second non-conductive vent member 1008, and a second solid metal stator 1009. In FIG. 10A, the membrane 1007 is deflected away from first stator 1005 and toward second stator 1009, which draws the fluid (i.e., air) into the pump card in vents 1010 of first vent member 1006 and expels the fluid (i.e., air) from the pump card in vents 1011 of second vent member 1008. In FIG. 10B, the membrane 1007 is deflected toward first stator 1005 and away from second stator 1009, which expels the fluid (i.e., air) from the pump card in vents 1010 of first vent member 1006 and draws the fluid (i.e., air) into the pump card in vents 1011 of second vent member 1008.

As a result, the electroacoustic transducers of the present invention no longer arc, are lighter, smaller and much lower cost in that, excluding the membrane (which is incidental in cost compared to the other parts of the pump card), two of the five main parts have been eliminated.

These alterations in the design of the transducers of the present invention resulted in unexpected, remarkable, and dramatic improvements in performance of the loudspeaker systems of the present invention, while also lowering weight and manufacturing cost.

While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. The scope of protection is not limited by the description set out above, but is only limited by the claims which follow, that scope including all equivalents of the subject matter of the claims.

The disclosures of all patents, patent applications, and publications cited herein are hereby incorporated herein by reference in their entirety, to the extent that they provide exemplary, procedural, or other details supplementary to those set forth herein.

Amounts and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of approximately 1 to approximately 4.5 should be interpreted to include not only the explicitly recited limits of 1 to approximately 4.5, but also to include individual numerals such as 2, 3, 4, and sub-ranges such as 1 to 3, 2 to 4, etc. The same principle applies to ranges reciting only one numerical value, such as "less than approximately 4.5," which should be interpreted to include all of the above-recited values and ranges. Further, such an interpretation should apply regardless of the breadth of the range or the characteristic being described.

Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are now described.

Following long-standing patent law convention, the terms "a" and "an" mean "one or more" when used in this application, including the claims.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in this specification and attached claims are approximations that can vary depending upon the desired properties sought to be obtained by the presently disclosed subject matter.

As used herein, the term "about" and "substantially" when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, the term "substantially perpendicular" and "substantially parallel" is meant to encompass variations of in some embodiments within ±10° of the perpendicular and parallel directions, respectively, in some embodiments within ±5° of the perpendicular and parallel directions, respectively, in some embodiments within ±1° of the perpendicular and parallel directions, respectively, and in some embodiments within ±0.5° of the perpendicular and parallel directions, respectively.

As used herein, the term "and/or" when used in the context of a listing of entities, refers to the entities being present singly or in combination. Thus, for example, the phrase "A, B, C, and/or D" includes A, B, C, and D individually, but also includes any and all combinations and subcombinations of A, B, C, and D.

What is claimed is:

1. A method of manufacturing electroacoustic transducer card stacks comprising the steps of:

(a) forming a plurality of panel stacks, wherein the step of forming a panel stack in the plurality of panel stacks comprises (i) bonding a first side of an electrically conductive stator panel comprising a plurality of electrically conductive stators to a first side of a first vent member panel comprising a plurality of first vent members, (ii) bonding a first side of a electrically conductive membrane to the second side of the first vent member panel while maintaining the electrically conductive membrane under tension, wherein the step of bonding the first side of the electrically conductive membrane to the second side of the first vent member panel comprises applying a force to the electrically conductive membrane to maintain the electrically conductive membrane under tension, and (iii) bonding a first side of a second vent member panel to the second side of the electrically conductive membrane, wherein before the step of bonding the first side of the second vent member panel to the second side of the electrically conductive membrane, the application of the force to the electrically conductive membrane is discontinued.

2. The method of claim 1, wherein (a) the electrically conductive stator panel comprising at least 10 electrically conductive stators;

(b) the first vent member panel comprising at least 10 first vent members;

(c) the second vent member panel comprising at least 10 second vent members; and (d) the step of cutting the bonded stack of panel stacks to create the plurality of electroacoustic transducer card stacks creates at least 10 electroacoustic transducer cards.

3. The method of claim 1, wherein the bonding comprises bonding with epoxy.

4. The method of claim 3 further comprising curing the epoxy before the step of cutting the bonded stack of panel stacks.

5. The method of claim 1, wherein each of the first vent members in the plurality of first vent member panels and each of the second vent members in the plurality of second vent member panels is an electrical insulator.

6. The method of claim 1, wherein the thickness of each of the first vent members in the plurality of first vent member panels and each of the second vent members in the plurality of second vent member panels is between 0.1 mm and 1 mm.

7. The method of claim 1, wherein after the application of the force to the electrically conductive membrane is discontinued and before the step of bonding the first side of the second vent member panel to the second side of the electrically conductive membrane, the electrically conductive membrane is cut to remove any excess electrically conductive material.

8. The method of claim 1, wherein the step of forming plurality of panel stacks occurs in the absence of bonding a frame to the panel of stacks in the plurality of panel stacks.

9. The method of claim 1 further comprising stacking and bonding the panel stacks in the plurality of panel stacks to form a bonded stack of panel stacks, wherein, for adjacent panel stacks in the bonded stack of panel stacks, the second side of the second vent member panel of a first adjacent panel stack in the two adjacent panel stacks is bonded to the second side of the electrically conductive stator panel of a second adjacent panel stack in the two adjacent panel stacks.

10. The method of claim 9, wherein the step of stacking and bonding the panel stacks in the plurality of panel stacks comprises stacking and bonding at least 10 panel stacks.

11. A method of manufacturing electroacoustic transducer card stacks comprising the steps of:

(a) forming a plurality of panel stacks, wherein the step of forming a panel stack in the plurality of panel stacks comprises (i) bonding a first side of an electrically conductive stator panel comprising a plurality of electrically conductive stators to a first side of a first vent member panel comprising a plurality of first vent members, (ii) bonding a first side of a electrically conductive membrane to the second side of the first vent member panel while maintaining the electrically conductive membrane under tension, and (iii) bonding a first side of a second vent member panel to the second side of the electrically conductive membrane;

(b) stacking and bonding the panel stacks in the plurality of panel stacks to form a bonded stack of panel stacks, wherein, for adjacent panel stacks in the bonded stack of panel stacks, the second side of the second vent member panel of a first adjacent panel stack in the two adjacent panel stacks is bonded to the second side of the electrically conductive stator panel of a second adjacent panel stack in the two adjacent panel stacks; and (c) cutting the bonded stack of panel stacks to create a plurality of electroacoustic transducer card stacks, wherein (i) the conductive membranes are each movable along a first axis, (ii) the cutting of the bonded stack of panel stack cuts the first vent member panel to form a plurality of first vent fingers arranged so that air can flow between the plurality of first vent fingers along a second axis, and (iii) the first axis and the second axis are substantially perpendicular.

12. The method of claim 11, wherein the cutting of the bonded stack of panel stack cuts the second vent member panel to form a plurality of second vent fingers arranged so that air can flow between the plurality of second vent fingers along the second axis.

13. The method of claim 11 further comprising stacking and bonding at least some of the plurality of the electroacoustic transducer card stacks after the step of cutting.

14. A method of manufacturing electroacoustic transducer card stacks comprising the steps of:

(a) forming a plurality of panel stacks, wherein the step of forming a panel stack in the plurality of panel stacks comprises (i) bonding a first side of an electrically conductive stator panel comprising a plurality of electrically conductive stators to a first side of a first vent member panel comprising a plurality of first vent members, (ii) bonding a first side of a electrically conductive membrane to the second side of the first vent member panel while maintaining the electrically conductive membrane under tension, and (iii) bonding a first side of a second vent member panel to the second side of the electrically conductive membrane; and (b) cutting each of the panel stacks in the plurality of panel stacks to create a plurality of electroacoustic transducer cards, wherein for each panel stack (i) the conductive membranes are each movable along a first axis, (ii) the cutting of the panel stack cuts the first vent member panel to form a plurality of first vent fingers arranged so that air can flow between the plurality of first vent fingers along a second axis, and (iii) the first axis and the second axis are substantially perpendicular.

* * * * *